US010144996B2

(12) United States Patent
Takashima et al.

(10) Patent No.: US 10,144,996 B2
(45) Date of Patent: Dec. 4, 2018

(54) HIGH STRENGTH COLD ROLLED STEEL SHEET WITH LOW YIELD RATIO AND METHOD OF MANUFACTURING THE SAME

(71) Applicant: JFE Steel Corporation, Tokyo (JP)

(72) Inventors: Katsutoshi Takashima, Chiba (JP); Yuki Toji, Kurashiki (JP); Hideyuki Kimura, Fukuyama (JP); Kohei Hasegawa, Tokyo (JP)

(73) Assignee: JFE Steel Corporation (JP)

( * ) Notice: Subject to any disclaimer, the term of this patent is extended or adjusted under 35 U.S.C. 154(b) by 461 days.

(21) Appl. No.: 14/648,778

(22) PCT Filed: Dec. 4, 2013

(86) PCT No.: PCT/JP2013/007135
§ 371 (c)(1),
(2) Date: Jun. 1, 2015

(87) PCT Pub. No.: WO2014/097559
PCT Pub. Date: Jun. 26, 2014

(65) Prior Publication Data

US 2015/0322552 A1 Nov. 12, 2015

(30) Foreign Application Priority Data

Dec. 18, 2012 (JP) ..... 2012-275627

(51) Int. Cl.

| | |
|---|---|
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/38*** | (2006.01) |
| ***C22C 38/18*** | (2006.01) |

(52) U.S. Cl.

CPC ..... *C22C 38/38* (2013.01); *C21D 6/001* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0247* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C21D 2211/001* (2013.01); *C21D 2211/002* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | |
|---|---|---|---|
| 2006/0130937 | A1 | 6/2006 | Ikeda et al. |
| 2012/0037282 | A1 | 2/2012 | Kawasaki et al. |
| 2012/0279617 | A1 | 11/2012 | Kawasaki et al. |

FOREIGN PATENT DOCUMENTS

| | | |
|---|---|---|
| JP | 11-61326 | 3/1999 |
| JP | 11-189839 | 7/1999 |
| JP | 3508657 B2 | 3/2004 |
| JP | 3936440 B2 | 6/2007 |
| JP | 2007-211280 | 8/2007 |
| JP | 2008-297609 | 12/2008 |
| JP | 4288364 B2 | 7/2009 |
| JP | 2010-255097 | 11/2010 |
| JP | 2011-149066 | 8/2011 |
| JP | 2012-41573 | 3/2012 |
| JP | 2012-219341 | 11/2012 |

OTHER PUBLICATIONS

Notification of Reason for Refusal dated Sep. 20, 2016, of corresponding Korean Application No. 10-2015-7015525, including an English translation and a Concise Statement of Relevance of Office Action in English.

Hundy, B., "The Strain-Age Hardening of Mild Steel," Metallurgia, vol. 52, May 1956, pp. 203-211.

"X sen kaisetsu handobukku" ("X-ray Diffraction Handbook"), 2000, pp. 26, 62-64.

Chinese Office Action dated Apr. 6, 2016, of corresponding Chinese Application No. 2013800664805, along with an English translation of the Search Report.

(Continued)

*Primary Examiner* — Colin W. Slifka
(74) *Attorney, Agent, or Firm* — DLA Piper LLP (US)

(57) ABSTRACT

A high strength cold rolled steel sheet with a low yield ratio has a chemical composition containing C: 0.05% to 0.10%, Si: 0.6% to 1.3%, Mn: 1.4% to 2.2%, P: 0.08% or less, S: 0.010% or less, Al: 0.01% to 0.08%, N: 0.010% or less, and the remainder being Fe and incidental impurities, on a percent by mass basis, and a microstructure in which the average grain size of ferrite is 15 μm or less, the volume fraction of ferrite is 70% or more, the volume fraction of bainite is 3% or more, the volume fraction of retained austenite is 4% to 7%, the average grain size of martensite is 5 μm or less, and the volume fraction of martensite is 1% to 6%, wherein the average C concentration (percent by mass) in the retained austenite is 0.30% to 0.70%, yield ratio is 64% or less, and the tensile strength is 590 MPa or more.

6 Claims, No Drawings

(56) References Cited

OTHER PUBLICATIONS

Supplementary European Search Report dated Jan. 20, 2016 of corresponding European Application No. 13864281.4.
Chinese Office Action dated Dec. 2, 2016, of corresponding Chinese Application No. 2013800664805, along with a Concise Statement of Relevance of Office Action in English.

HIGH STRENGTH COLD ROLLED STEEL SHEET WITH LOW YIELD RATIO AND METHOD OF MANUFACTURING THE SAME

TECHNICAL FIELD

This disclosure relates to a high strength cold rolled steel sheet with a low yield ratio and a method of manufacturing the same. In particular, the disclosure relates to a high strength cold rolled steel sheet suitable for members of structural parts of automobiles and the like.

BACKGROUND

In recent years, there has been a growing interest in environmental issues and $CO_2$ output regulation has become severe. In the field of automobiles, an improvement in fuel efficiency through car body weight reduction has been a large issue. Consequently, reduction in thickness through application of high strength steel sheets to automotive parts has been pursued and steel sheets having tensile strength TS of 590 MPa or more have been applied.

The high strength steel sheet used for structural members and reinforcing members of automobiles is required to have excellent elongation and stretch-flange-formability. In particular, a high strength steel sheet used to form parts having complicated shapes is required to have both excellent elongation and stretch-flange-formability rather than a single characteristic of them. In addition, it may take time (elapsed time) from production of the high strength steel sheet until the steel sheet concerned is actually subjected to press forming, and it is an important characteristic of the high strength steel sheet that elongation is not degraded because of aging in this elapsed time.

Also, the high strength steel sheet used for structural members and reinforcing members of automobiles is required to have high dimensional accuracy because the high strength steel sheet is press-formed and, thereafter, assembled and modularized by arc welding, spot welding or the like. Therefore, it is necessary that spring-back and the like of such a high strength steel sheet does not occur after forming so that a low yield ratio is required before forming. In this regard, the yield ratio (YR) is a value indicating the ratio of yield strength (YS) to tensile strength (TS) and is represented by YR (%)=(YS/TS)×100(%).

A dual phase steel (DP steel) having a ferrite-martensite multi-phase is known as a high strength steel sheet with a low yield ratio, having formability and high strength in combination. The DP steel is a multi-phase steel in which martensite is dispersed in ferrite serving as a main phase and has high TS, a low yield ratio, and an excellent elongation characteristic. However, the DP steel has a disadvantage that the stretch-flange-formability is poor, because cracking easily occurs owing to concentration of applied force at the interface between ferrite and martensite.

Then, for example, technologies of Japanese Patent No. 3936440 and Japanese Unexamined Patent Application Publication No. 2008-297609 have been proposed to allow even the DP steel to have excellent stretch-flange-formability. Japanese Patent No. 3936440 discloses an automotive high strength steel sheet, where the space factors of ferrite and martensite relative to the entire microstructure and the average grain sizes thereof are controlled and fine martensite is dispersed in a steel so that degradation of the stretch-flange-formability is suppressed and, thereby, both collision safety and formability are ensured. Japanese Unexamined Patent Application Publication No. 2008-297609 discloses a high strength steel sheet, where elongation and stretch-flange-formability of a multi-phase steel sheet mainly including a ferrite phase and a martensite phase are improved by controlling the space factors of fine ferrite having an average grain size of 3 μm or less and martensite having an average grain size of 6 μm or less relative to the entire microstructure.

In addition, a TRIP steel sheet (transformation induced plasticity) is mentioned as a steel sheet having high strength and excellent ductility in combination. The TRIP steel sheet includes retained austenite in the steel sheet microstructure thereof. When the TRIP steel sheet is subjected to forming at a temperature higher than or equal to the martensite transformation start temperature, large elongation is obtained through stress induced transformation of retained austenite into martensite. However, in this TRIP steel sheet, retained austenite is transformed into martensite during blanking and, thereby, cracking occurs at the interface with ferrite. Consequently, the TRIP steel sheet has a disadvantage that the stretch-flange-formability is poor.

Then, a technology has been proposed, wherein even the TRIP steel sheet is provided with excellent stretch-flange-formability in addition to excellent ductility (elongation). For example, Japanese Patent No. 3508657 discloses a high strength cold rolled steel sheet exhibiting improved stretch-flange-formability and having a multi-phase composed of ferrite, retained austenite, and a phase generated at low temperature. Japanese Patent No. 3508657 discloses that the stretch-flange-formability is improved by making the ferrite grain size fine through addition of an appropriate amount of Ti and controlling the shape of sulfide based inclusions through addition of Ca and/or REM. Also, Japanese Patent No. 4288364 discloses a multi-phase cold rolled steel sheet having a multi-phase including ferrite, retained austenite, and the remainder composed of bainite and martensite and having excellent elongation and stretch-flange-formability. Japanese Patent No. 4288364 discloses that the aspect ratios and average grain sizes of martensite and retained austenite are specified and, in addition, the numbers per unit area of martensite and retained austenite are specified.

On the other hand, when a part having a particularly complicated shape is press-formed by using the above-described high strength steel sheet having TS of 590 MPa or more, further reduction in YR is required and, in addition, excellent elongation and stretch-flange-formability are required. For example, a steel sheet having a tensile strength (TS) of 590 MPa or more and a yield ratio (YR) of 64% or less, where the hole expansion ratio serving as an index of the stretch-flange-formability of 60% or more and the elongation (total elongation) of 31% or more can be ensured, has been desired.

However, conventional high strength steel sheets cannot sufficiently satisfy such characteristics. For example, in Japanese Patent No. 3936440, enough stretch-flange-formability for press forming cannot be ensured, although the average grain sizes of ferrite and martensite of the steel sheet are specified. Japanese Unexamined Patent Application Publication No. 2008-297609 has a problem that the volume fraction of martensite in the resulting steel sheet is considerably large and, thereby, elongation is insufficient in relation to strength. Japanese Patent No. 3508657 and Japanese Patent No. 4288364 have the problem that YR of the resulting steel sheet is high and, thereby, spring-back and the like occur easily after forming. As described above, in the actual situation of conventional high strength steel sheets, a steel sheet which has achieved the above-described high strength and low yield ratio and which has excellent elongation and stretch-flange-formability in combination has not been developed.

It could therefore be helpful to provide a high strength steel sheet having excellent elongation, excellent stretch-flange-formability, and a low yield ratio and a method of manufacturing the same. Specifically, a high strength steel sheet with a low yield ratio and a method of manufacturing the same are needed, where the yield ratio (YR)≤64% and the tensile strength (TS)≥590 MPa are satisfied so that the hole expansion ratio (λ)≥60% and the total elongation (EL)≥31% can be ensured.

SUMMARY

We found that a high strength steel sheet having excellent stretch-flange-formability in addition to a high elongation characteristic, while a low yield ratio was ensured, was able to be obtained on the basis of the following items I) and II).

I) To specify the volume fractions of ferrite, bainite, retained austenite, and martensite of the steel sheet microstructure to be within specific ranges.

II) To specify the average grain sizes of ferrite and martensite and the C concentration in retained austenite to be within specific ranges.

That is, in the hole expanding test to evaluate the stretch-flange-formability, micro-voids are generated at the interface between ferrite and martensite in the steel sheet microstructure of the DP steel during blanking, and the voids are connected to each other and developed during the hole expansion process thereafter so that cracking occurs. When retained austenite is present in the steel sheet microstructure, if an average C concentration in retained austenite is high, martensite transformation is suppressed during the blanking and the hole expansion ratio increases. However, the yield ratio increases in such a steel sheet. On the other hand, if the average C concentration in retained austenite is low, retained austenite is transformed into martensite at the time of blanking and, therefore, voids are generated at the interface with ferrite so that the hole expansion property (stretch-flange-formability) is not good.

We also found that the number of voids generated during the blanking was able to be reduced on the basis of the following items i) to iv) and, thereby, the stretch-flange-formability was able to be improved even when the average C concentration in retained austenite was low.

i) To perform solid solution strengthening of ferrite by addition of an appropriate amount of Si.

ii) To decrease the volume fraction of a hardened phase serving as a void generation source.

iii) To contain bainite serving as a phase having the hardness between ferrite and hardened phase into the steel sheet microstructure.

iv) To make the average grain sizes of ferrite and martensite fine.

Also, we found that containing a predetermined amount of martensite in the steel sheet microstructure contributes to ensuring of a low YR and an improvement in strength-elongation balance and, thereby, high strength and high elongation were able to be ensured in combination. In addition, we found that the average C concentration within the range of 0.30% to 0.70% in retained austenite was able to contribute to an improvement in elongation, while the low YR was ensured.

That is, we found that improvements in elongation and stretch-flange-formability and prevention of degradation in elongation due to aging, while a low yield ratio was ensured, were possible on the basis of the following items A) to C).

A) To specify the average C concentration in retained austenite to be 0.30% to 0.70% by adding Si within the range of 0.6% to 1.3%, adding C within the range of 0.05% to 0.10%, and performing a heat treatment under an appropriate annealing condition.

B) To make the grain sizes of ferrite and martensite fine.

C) To control the volume fractions of bainite, retained austenite, and martensite within the ranges not impairing the strength and the elongation.

We thus provide:

(1) A high strength cold rolled steel sheet with a low yield ratio, having a chemical composition containing C: 0.05% to 0.10%, Si: 0.6% to 1.3%, Mn: 1.4% to 2.2%, P: 0.08% or less, S: 0.010% or less, Al: 0.01% to 0.08%, N: 0.010% or less, and the remainder being Fe and incidental impurities, on a percent by mass basis, and a microstructure in which the average grain size of ferrite is 15 μm or less, the volume fraction of ferrite is 70% or more, the volume fraction of bainite is 3% or more, the volume fraction of retained austenite is 4% to 7%, the average grain size of martensite is 5 μm or less, and the volume fraction of martensite is 1% to 6%, wherein the average C concentration (percent by mass) in the above-described retained austenite is 0.30% to 0.70% and as for the steel sheet characteristics, the yield ratio is 64% or less and the tensile strength is 590 MPa or more.

(2) The high strength cold rolled steel sheet with a low yield ratio, according to the above-described item (1), further containing at least one of V: 0.10% or less, Ti: 0.10% or less, and Nb: 0.10% or less on a percent by mass basis.

(3) The high strength cold rolled steel sheet with a low yield ratio, according to the above-described item (1) or item (2), further containing at least one of Cr: 0.50% or less and Mo: 0.50% or less on a percent by mass basis.

(4) The high strength cold rolled steel sheet with a low yield ratio, according to any one of the above-described items (1) to (3), further containing at least one of Cu: 0.50% or less and Ni: 0.50% or less on a percent by mass basis.

(5) The high strength cold rolled steel sheet with a low yield ratio, according to any one of the above-described items (1) to (4), further containing B: 0.0030% or less on a percent by mass basis.

(6) The high strength cold rolled steel sheet with a low yield ratio, according to any one of the above-described items (1) to (5), further containing 0.0050% or less in total of at least one of Ca and REM on a percent by mass basis.

(7) A method of manufacturing a high strength cold rolled steel sheet with a low yield ratio, including the steps of preparing a steel slab having the chemical composition according to any one of the above-described items (1) to (6), performing hot rolling to produce a steel sheet, performing pickling, subjecting the pickled steel sheet to cold rolling, and performing annealing under the conditions of performing heating to an annealing temperature in a temperature range of 780° C. to 900° C. at an average heating rate of 3° C./s to 30° C./s, performing holding at the annealing temperature for 30 to 500 s, performing cooling to a first cooling temperature within a temperature range of (annealing temperature—10° C.) to (annealing temperature—30° C.) at a first average cooling rate of 5° C./s or less, performing cooling to a second cooling temperature within a temperature range of 350° C. to 450° C. at a second average cooling rate of 5° C./s to 30° C./s, and performing cooling to room temperature at a third average cooling rate of 5° C./s or less.

(8) A method of manufacturing a high strength cold rolled steel sheet with a low yield ratio, including the steps of preparing a steel slab having the chemical composition according to any one of the above-described items (1) to (6), performing hot rolling under the conditions of steel slab temperature: 1,150° C. to 1,300° C. and finishing delivery temperature: 850° C. to 950° C., starting cooling within 1 second after finishing of the hot rolling, performing cooling to 550° C. or lower at an average cooling rate of 50° C./s or more, performing coiling after the cooling to produce a hot rolled steel sheet, performing pickling, subjecting the pickled hot rolled steel sheet to cold rolling, and performing annealing under the conditions of performing heating to an annealing temperature in a temperature range of 780° C. to 900° C. at an average heating rate of 3° C./s to 30° C./s, performing holding at the annealing temperature for 30 to 500 s, performing cooling to a first cooling temperature within a temperature range of (annealing temperature—10° C.) to (annealing temperature—30° C.) at a first average cooling rate of 5° C./s or less, performing cooling to a second cooling temperature within a temperature range of 350° C. to 450° C. at a second average cooling rate of 5° C./s to 30° C./s, and performing cooling to room temperature at a third average cooling rate of 5° C./s or less.

A high strength cold rolled steel sheet having TS of 590 MPa or more and a low yield ratio YR of 64% or less and exhibiting excellent elongation and stretch-flange-formability, where the total elongation is 31% or more, the hole expansion ratio is 60% or more, and degradation in the elongation due to aging does not occur, can be obtained stably.

DETAILED DESCRIPTION

Our steel sheets and methods will be described below in detail. In this regard, hereafter the term "%" related to the chemical composition refers to "percent by mass" unless otherwise specified.

Reasons for the limitation of the chemical composition to the above-described range will be described.

C: 0.05% to 0.10%

Carbon is an element effective in increasing the strength of the steel sheet and contributes to enhancement of the strength in relation to formation of secondary phases, e.g., retained austenite, martensite and the like. If the amount of C is less than 0.05%, it is difficult to ensure the necessary volume fractions of bainite, retained austenite, and martensite. Therefore, the amount of C is 0.05% or more, and preferably 0.07% or more. On the other hand, if C is excessively added, it becomes difficult to specify the average C concentration in retained austenite to be 0.70% or less and the yield ratio increases. Consequently, the upper limit of the amount of C is 0.10%, and preferably less than 0.10%.

Si: 0.6% to 1.3%

Silicon is a ferrite-forming element and also is an element effective in solid solution strengthening. To improve the balance between the strength and the elongation and ensure the hardness of ferrite, the amount of Si of 0.6% or more is necessary. Also, to ensure the stability of retained austenite, it is necessary to specify the amount of Si to be 0.6% or more, and preferably 0.7% or more. However, if Si is excessively added, the chemical conversion treatability is degraded. Therefore, the content thereof is 1.3% or less, and preferably 1.2% or less.

Mn: 1.4% to 2.2%

Manganese is an element that contributes to enhancement of the strength through solid solution strengthening and formation of a secondary phase. Also, Mn is an element to stabilize austenite and is necessary to control the fraction of the secondary phases. To obtain the effects, it is necessary to contain 1.4% or more of Mn. On the other hand, if Mn is excessively contained, the volume fraction of martensite becomes excessive so that the Mn content is 2.2% or less, and preferably 2.1% or less.

P: 0.08% or Less

If the P content increases, segregation of P at grain boundaries becomes considerable so that the grain boundaries are embrittled and weldability is degraded. Therefore, the P content is 0.08% or less, preferably 0.05% or less, and more preferably 0.04% or less. The lower limit is not particularly specified. However, if the amount of P is extremely reduced, the steel production cost increases. Consequently, the lower limit of the amount of P is preferably about 0.001%.

S: 0.010% or Less

When the S content is large, large amounts of sulfides, e.g., MnS, are generated and local elongation typified by stretch-flange-formability is degraded. Therefore, the upper limit of the content is 0.010%, and preferably 0.005% or less. The lower limit is not particularly specified. However, if the amount of S is extremely reduced, the steel production cost increases. Consequently, the lower limit of the amount of S is preferably about 0.0005%.

Al: 0.01% to 0.08%

Aluminum is an element necessary for deoxidation and to obtain this effect, it is necessary that the content be 0.01% or more. Even when the Al content is more than 0.08%, the effect is saturated and, therefore, the amount of Al is 0.08% or less, and preferably 0.05% or less.

N: 0.010% or Less

Nitrogen forms a coarse nitride and degrades bendability and stretch-flange-formability. Therefore, it is necessary that the content be reduced. In this regard, if the N content is more than 0.010%, this tendency becomes considerable. Therefore, the N content is 0.010% or less, and preferably 0.005% or less. The lower limit is not particularly specified. However, the lower limit of the amount of N is preferably about 0.0002%.

The indispensable components are as described above. At least one element described in the following items a) to e) may be added in addition to the above-described components from the reasons described below.

a) At Least One of V: 0.10% or Less, Ti: 0.10% or Less, and Nb: 0.10% or Less

V: 0.10% or Less

Vanadium can contribute to enhancement of strength through formation of fine carbonitrides. To obtain such an effect, the V content is preferably 0.01% or more. On the other hand, even when a large amount of V is added, a strength-enhancing effect of an excess amount over 0.10% is small and, in addition, an increase in alloy cost is caused. Therefore, the V content is 0.10% or less.

Ti: 0.10% or Less

Titanium can also contribute to enhancement of strength, as with V, through formation of fine carbonitrides and, therefore, can be added as necessary. To exert such an effect, the Ti content is preferably 0.005% or more. On the other hand, if a large amount of Ti is added, the elongation is reduced considerably. Consequently, the content thereof is 0.10% or less.

Nb: 0.10% or Less

Niobium can also contribute to enhancement of strength, as with V, through formation of fine carbonitrides and, therefore, can be added as necessary. To exert such an effect, the Nb content is preferably 0.005% or more. On the other hand, if a large amount of Nb is added, the elongation is reduced considerably. Consequently, the content thereof is 0.10% or less.

b) At Least One of Cr: 0.50% or Less and Mo: 0.50% or Less

Cr: 0.50% or Less

Chromium is an element that contributes to enhancement of strength through formation of a secondary phase and, therefore, can be added as necessary. To exert this effect, the content is preferably 0.10% or more. On the other hand, if the content is more than 0.50%, martensite is excessively generated so that the content thereof is 0.50% or less.

Mo: 0.50% or Less

Molybdenum can also contribute to enhancement of strength, as with Cr, through generation of a secondary phase, and can be added as necessary. Meanwhile, Mo further contributes to enhancement of strength because part of Mo generates carbides. To exert these effects, the content is preferably 0.05% or more. On the other hand, even when the content is more than 0.50%, the effect is saturated. Therefore, the content thereof is 0.50% or less.

c) At Least One of Cu: 0.50% or Less and Ni: 0.50% or Less

Cu: 0.50% or Less

Copper is an element that contributes to enhancement of strength through solid solution strengthening, is an element to contribute to enhancement of strength through generation of a secondary phase, and can be added as necessary. To exert these effects, the content is preferably 0.05% or more. On the other hand, even when the content is more than 0.50%, the effect is saturated and surface defects resulting from Cu occur easily. Consequently, the Cu content is 0.50% or less.

Ni: 0.50% or Less

In the same manner as Cu, Ni is an element that contributes to enhancement of strength through solid solution strengthening, is an element to contribute to enhancement of strength through generation of a secondary phase, and can be added as necessary. To exert these effects, the content is preferably 0.05% or more. Meanwhile, addition at the same time with Cu has an effect of suppressing surface defects resulting from Cu. Consequently, addition of Ni is particularly effective when Cu is added. On the other hand, even when the content is more than 0.50%, the effect is saturated. Therefore, the content thereof is 0.50% or less.

d) B: 0.0030% or Less

Boron is an element that contributes to enhancement of strength through an improvement of hardenability and through generation of a secondary phase and can be added as necessary. To exert these effects, the content is preferably 0.0005% or more. On the other hand, even when the content is more than 0.0030%, the effect is saturated. Consequently, the content thereof is 0.0030% or less.

e) 0.0050% or Less in Total of at Least One of Ca and REM

Each of Ca and REM (rare earth metal) is an element that contributes to an improvement of adverse effects of sulfides on the stretch-flange-formability through spheroidization of the shapes of sulfides and can be added as necessary. To exert these effects, it is preferable that 0.0005% or more in total of at least one of Ca and REM be contained. On the other hand, even when more than 0.0050% in total of at least one of Ca and REM is contained, these effects are saturated. Consequently, in either single addition or combined addition of Ca and REM, the total content thereof is 0.0050% or less. In this regard, the total content thereof is preferably 0.0005% or more.

The remainder other than those described above is Fe and incidental impurities. Examples of incidental impurities include Sb, Sn, Zn, and Co. The allowable ranges of contents of them are Sb: 0.01% or less, Sn: 0.1% or less, Zn: 0.01% or less, and Co: 0.1% or less. Meanwhile, the effects thereof are not impaired even when Ta, Mg, and Zr within their respective ranges of common steel compositions are contained.

Next, the microstructure of the high strength cold rolled steel sheet will be described in detail. The high strength cold rolled steel sheet has a microstructure in which the average grain size of ferrite is 15 μm or less, the volume fraction of ferrite is 70% or more, the volume fraction of bainite is 3% or more, the volume fraction of retained austenite is 4% to 7%, the average grain size of martensite is 5 μm or less, and the volume fraction of martensite is 1% to 6%. The volume fraction described here is a volume fraction relative to the entire steel sheet and the same goes hereafter.

Average Grain Size of Ferrite is 15 μm or Less and Volume Fraction is 70% or More If the volume fraction of ferrite is less than 70%, a high proportion of hardened secondary phase is present so that many places having hardness exhibiting large differences from the hardness of mild ferrite are present and the stretch-flange-formability is degraded. Consequently, the volume fraction of ferrite is 70% or more, and preferably 75% or more. In this regard, the volume fraction of ferrite is preferably 92% or less to ensure TS.

Meanwhile, if the average grain size of ferrite is more than 15 μm, voids are generated easily in a blanked edge face during hole expansion, and good stretch-flange-formability is not obtained. Consequently, the average grain size of ferrite is 15 μm or less, and preferably 13 μm or less. In this regard, the average grain size of ferrite is preferably 3 μm or more because the strength is extremely increased under the influence of the grain size being made fine.

Volume Fraction of Bainite is 3% or More

To ensure good stretch-flange-formability, it is necessary that the volume fraction of bainite be 3% or more. The upper limit is not particularly specified. However, 15% or less is preferable, and 12% or less is more preferable to ensure good elongation. In this regard, the volume fraction of bainite phase described here is a proportion of bainitic ferrite (ferrite having a high dislocation density) in an observed surface on a volume basis.

Volume Fraction of Retained Austenite is 4% to 7%

To ensure good elongation, it is necessary that the volume fraction of retained austenite be 4% or more. If the volume fraction of retained austenite is more than 7%, stretch-flange-formability is degraded. Consequently, the upper limit thereof is 7%.

Average Grain Size of Martensite is 5 μm or Less and Volume Fraction is 1% to 6%

To ensure predetermined strength and YR, it is necessary that the volume fraction of martensite be 1% or more, and 2% or more is preferable. To ensure good stretch-flange-formability, the volume fraction of hardened martensite is 6% or less. Meanwhile, if the average grain size of martensite is more than 5 μm, voids generated at the interface with ferrite are connected to each other easily, and the stretch-flange-formability is degraded. Consequently, the upper limit thereof is 5 μm. The average grain size of martensite is preferably 4 μm or less. In this regard, the average grain size of martensite is preferably 0.1 μm or more, although not limited thereto.

Next, the C content in retained austenite will be described.

Average C Concentration (Percent by Mass) in Retained Austenite is 0.30% to 0.70%

If the average C concentration in retained austenite is less than 0.30%, there is no effect which contributes to the elongation characteristic. If the concentration is more than 0.70%, YR increases. Consequently, the C concentration in retained austenite of the steel sheet is 0.30% to 0.70%, and preferably 0.40% or more and less than 0.70%.

Meanwhile, in the steel sheet, at least one of pearlite, spheroidal cementite, and the like may be generated besides the above-described ferrite, bainite, retained austenite, and martensite. In such cases as well, the above-described volume fractions of ferrite, bainite, retained austenite, and martensite, average grain sizes of ferrite and martensite, and C concentration in retained austenite are satisfied.

The high strength cold rolled steel sheet has the above-described chemical composition and microstructure, has the above-described average C concentration in retained austenite, and has the steel sheet characteristics such as, the yield ratio of 64% or less and the tensile strength of 590 MPa or more.

Next, a method of manufacturing the high strength cold rolled steel sheet will be described.

The high strength cold rolled steel sheet can be produced by preparing a steel slab having the above-described chemical composition (chemical components), performing hot rolling to produce a steel sheet, performing pickling, subjecting the pickled steel sheet to cold rolling and, thereafter, performing annealing under the conditions of performing heating to an annealing temperature in a temperature range of 780° C. to 900° C. at an average heating rate of 3° C./s to 30° C./s, performing holding at the annealing temperature for 30 to 500 s, then performing cooling to a first cooling temperature within a temperature range of (annealing temperature—10° C.) to (annealing temperature—30° C.) at a first average cooling rate of 5° C./s or less, then performing cooling to a second cooling temperature within a temperature range of 350° C. to 450° C. at a second average cooling rate of 5° C./s to 30° C./s, and then performing cooling to room temperature at a third average cooling rate of 5° C./s or less.

The annealing condition is the most important. Meanwhile, as for the hot rolling step, preferably, hot rolling is performed under the conditions of steel slab temperature: 1,150° C. to 1,300° C. and finishing delivery temperature: 850° C. to 950° C., cooling is started within 1 second after finishing of hot rolling, cooling to 550° C. or lower is performed at an average cooling rate of 50° C./s or more and, thereafter, coiling is performed to produce a hot rolled steel sheet.

The above-described manufacturing method will be described below in detail.

In this regard, preferably, the steel slab is produced by a continuous casting method to prevent macro-segregation of components. However, production can also be performed by an ingot-making method or a thin slab casting method. Also, a conventional method may be employed in which after a steel slab is produced, the resulting slab is temporarily cooled to room temperature and, subsequently, re-heating is performed. Alternatively, the resulting steel slab is not cooled and a warm piece may be put into a soaking furnace on an "as is" basis. Alternatively, the resulting steel slab is subjected to heat retaining and, immediately thereafter, hot rolling may be performed. Alternatively, energy-saving processes, e.g., hot charge rolling or direct rolling, in which a steel slab after casting is hot rolled on an "as is" basis, can be applied without problems.

Hot Rolling Step

Temperature of Steel Slab (Hot Rolling Start Temperature): 1,150° C. to 1,300° C.

At the start of hot rolling, it is preferable that the temperature of the steel slab is 1,150° C. to 1,300° C. from the viewpoint of the productivity and the production cost. If the temperature of the steel slab (hot rolling start temperature) is lower than 1,150° C., a rolling load increases and the productivity tends to be reduced. Meanwhile, even when the temperature is higher than 1,300° C., merely an increase in heating cost is caused.

In this regard, to specify the temperature of the steel slab to be within the above-described temperature range in the hot rolling, for example, the steel slab is cast and, thereafter, the hot rolling is started in the state in which the temperature of the slab has reached 1,150° C. to 1,300° C. without performing re-heating or the hot rolling may be started after re-heating the slab to 1,150° C. to 1,300° C. is performed.

Finishing Delivery Temperature: 850° C. to 950° C.

It is preferable that the hot rolling be finished in an austenite single phase region because the elongation and the stretch-flange-formability after annealing are improved through homogenization of microstructure in the steel sheet and reduction in anisotropy of the material. Consequently, the finishing delivery temperature is preferably 850° C. or higher. On the other hand, if the finishing delivery temperature is higher than 950° C., the hot rolled microstructure becomes coarse and the characteristics after annealing may be degraded. Consequently, the finishing delivery temperature in the hot rolling is preferably 950° C. or lower. Therefore, the finishing delivery temperature is preferably 850° C. to 950° C.

Starting Cooling within 1 Second after Finishing of Hot Rolling and Cooling to 550° C. or Lower at an Average Cooling Rate of 50° C./s or More By performing quenching to a ferrite region after the hot rolling is finished, fine ferrite grain sizes can be obtained along with promotion of the ferrite transformation and, in addition, the average grain size of ferrite after annealing can be made fine so that the stretch-flange-formability is improved. Consequently, it is preferable that cooling be started within 1 second after finishing of the hot rolling and it is preferable that quenching to 550° C. or lower be performed at an average cooling rate of 50° C./s or more. This average cooling rate is employed from the time of start of cooling until the coiling temperature of 550° C. or lower is reached. In this regard, the average cooling rate is preferably 1,000° C./s or less, although not specifically limited.

Coiling Temperature: 550° C. or Lower

If the coiling temperature is higher than 550° C., ferrite grains become coarse easily and, therefore, the upper limit of the coiling temperature is preferably 550° C., and further preferably 500° C. Although the lower limit of the coiling temperature is not particularly specified, 300° C. or higher is preferable because if the coiling temperature is too low, hardened bainite and martensite are excessively generated and a cold rolling load increases.

Pickling Step

After the hot rolling step, preferably, the resulting hot rolled steel sheet is subjected to pickling in an acidic step to remove scale on the hot rolled steel sheet surface layer. The conditions of the pickling step, e.g., a pickling condition, are not specifically limited and the pickling may be performed following a common method.

Cold Rolling Step

The hot rolled steel sheet after the pickling is subjected to a cold rolling step and is rolled into a cold rolled sheet having a predetermined sheet thickness, for example, a sheet thickness of about 0.5 mm to 3.0 mm. The cold rolling step is not specifically limited. In this regard, the rolling reduction of the cold rolling is preferably about 25% to 75%.

Annealing Step

To allow re-crystallization to proceed and, in addition, specify the microstructure of the steel sheet and the average amount of C in retained austenite to be within predetermined ranges, the conditions of the annealing step are important. The conditions of the annealing step will be described below.

Average Heating Rate: 3° C./s to 30° C./s

In heating to the annealing temperature which is a temperature within a two-phase region, the material can be stabilized by allowing sufficient recrystallization to proceed in the ferrite region. If heating to the annealing temperature is performed rapidly, recrystallization does not proceed easily. Therefore, the upper limit of average heating rate to the annealing temperature is 30° C./s. The upper limit of average heating rate to the annealing temperature is preferably 25° C./s. Conversely, if the heating rate is too small, ferrite grains become coarse and a predetermined average grain size is not obtained. Therefore, the lower limit of the average heating rate is 3° C./s. The lower limit of the average heating rate is preferably 4° C./s.

Annealing Temperature (Holding Temperature): 780° C. to 900° C.

It is necessary that the annealing temperature be a temperature in a two-phase region of ferrite and austenite. The predetermined volume fractions of ferrite, bainite, retained austenite, and martensite, average grain sizes of ferrite and martensite, and C concentration in retained austenite can be obtained by specifying the amounts of C, Si, and Mn to be within our above-described ranges and, in addition, specifying the annealing temperature to be a temperature within the range of 780° C. to 900° C. If the annealing temperature is lower than 780° C., the sufficient volume fractions of retained austenite and martensite capable of ensuring YR and elongation cannot be obtained because the volume fraction of austenite during annealing is small. In addition, if the annealing temperature is lower than 780° C., C is excessively concentrated into austenite so that the C concentration in retained austenite after annealing increases. Therefore, the annealing temperature is 780° C. or higher. On the other hand, if the annealing temperature is higher than 900° C., the grain size of austenite during annealing become coarse and, thereby, predetermined average grain sizes of ferrite and martensite cannot be obtained. Therefore, the annealing temperature is 900° C. or lower, and preferably 880° C. or lower.

Holding Time at Annealing Temperature (Annealing Time): 30 to 500 s

As for the above-described annealing temperature, to allow recrystallization to proceed and induce partial austenite transformation, holding at the annealing temperature for 30 s or more is necessary. On the other hand, if the holding time at the annealing temperature is too long, ferrite is coarsened and a predetermined average grain size is not obtained. Therefore, it is necessary to specify the holding time (annealing time) at the annealing temperature to be 500 s or less.

Performing Cooling from Annealing Temperature to First Cooling Temperature within Temperature Range of (Annealing Temperature—10° C.) to (Annealing Temperature—30° C.) at First Average Cooling Rate of 5° C./s or Less To obtain the above-described desired ferrite and make the average grain size of martensite fine, it is important to control cooling performed following the annealing-holding in the two-phase region and, thereby, allow ferrite transformation to proceed. In this regard, to increase the amount of ferrite transformation, cooling (first cooling) from the above-described annealing temperature to the first cooling temperature of (annealing temperature—10° C.) to (annealing temperature—30° C.) is performed, while the average cooling rate is 5° C./s or less.

If the average cooling rate (first average cooling rate) is more than 5° C./s, ferrite transformation does not proceed sufficiently. Therefore, the upper limit is 5° C./s. The first average cooling rate is preferably 4° C./s or less. The lower limit of the cooling rate is not particularly specified. However, to avoid excess concentration of C into austenite, the lower limit of the average cooling rate is preferably 1° C./s. If the first cooling temperature is higher than (annealing temperature—10° C.), ferrite transformation does not proceed sufficiently. If the first cooling temperature is lower than (annealing temperature—30° C.), C is excessively concentrated into austenite and, thereby, YR increases. Consequently, the temperature range of cooling at the first average cooling rate is (annealing temperature—10° C.) to (annealing temperature—30° C.).

Performing Cooling from First Cooling Temperature to Second Cooling Temperature within Temperature Range of 350° C. to 450° C. at Second Average Cooling Rate of 5° C./s to 30° C./s To control the volume fractions of a steel sheet microstructure, which is finally obtained after the annealing step, to 70% or more of ferrite, 3% or more of bainite, 4% to 7% of retained austenite, and 1% to 6% of martensite, second cooling is performed from the above-described first cooling temperature to a second cooling temperature within the temperature range of 350° C. to 450° C. at a second average cooling rate of 5° C./s to 30° C./s. If the second cooling temperature is lower than 350° C., lower bainite or bainite transformation is not facilitated and, therefore, desired volume fractions of bainite, retained austenite, and martensite are not obtained. Consequently, the second cooling temperature is 350° C. or higher. On the other hand, if the second cooling temperature is higher than 450° C., pearlite is excessively generated and, thereby, the elongation is reduced. Consequently, the second cooling temperature is 450° C. or lower.

Meanwhile, if the second average cooling rate is less than 5° C./s, pearlite is excessively generated during cooling and, thereby, the elongation is reduced. Consequently, the second average cooling rate is 5° C./s or more, and preferably 7° C./s or more. If the second average cooling rate is more than 30° C./s, bainite transformation does not proceed sufficiently so that the volume fraction of retained austenite is reduced and the volume fraction of martensite increases and, thereby, elongation and stretch-flange-formability are degraded. Consequently, the second average cooling rate is 30° C./s or less, and preferably 25° C./s or less.

Performing Cooling from Second Cooling Temperature to Room Temperature at Third Average Cooling Rate of 5° C./s or Less After cooling to the second cooling temperature within the temperature range of 350° C. to 450° C. is performed, third cooling, which is cooling to room temperature at an average cooling rate of 5° C./s or less, is performed to facilitate bainite transformation. If the average cooling rate in the third cooling is more than 5° C./s, martensite in the steel sheet microstructure is excessively generated, the volume fraction of martensite exceeds the desired range and, in addition, the average C concentration in retained austenite is more than 0.70%. Consequently, the average cooling rate from the second cooling temperature (third average cooling rate) is 5° C./s or less, and preferably 3° C./s or less. In this regard, the lower limit of the third average cooling rate is not particularly specified. However, the lower limit is preferably 0.1° C./s in consideration of an increase in hardness of martensite and degradation of hole expansion property.

In this regard, the cold rolled steel sheet may be subjected to temper rolling after annealing. A preferable range of elongation percentage is 0.3% to 2.0%.

The examples will be described below. However, as a matter of course, this disclosure is not limited to the following examples and execution on the basis of addition of any modification within the range compatible with the above-described steel sheets and methods is included in the technical scope of the disclosure.

Example 1

A slab having a thickness of 230 mm was produced by melting and casting a steel having the chemical composition shown in Table 1. Subsequently, heating the slab was performed, hot rolling was performed, where the temperature of the steel slab was 1,200° C. and the finishing delivery temperature (FDT) was a temperature shown in Table 2, cooling was performed after hot rolling with the elapsed time until start of cooling and the average cooling rate (Cooling rate) shown in Table 2 so that the sheet thickness: 3.2 mm was ensured and, thereafter, coiling was performed at the coiling temperature (CT) shown in Table 2 to obtain a hot rolled steel sheet. Then, the resulting hot rolled steel sheet was pickled and subjected to cold rolling so that a cold rolled sheet (sheet thickness: 1.4 mm) was produced. Subsequently, heating was performed at the average heating rate shown in Table 2 and annealing performed at the annealing temperature and the annealing time shown in Table 2. Thereafter, cooling to the first cooling temperature shown in Table 2 was performed at the first average cooling rate (Cooling rate 1), cooling to the second cooling temperature shown in Table 2 was performed at the second average cooling rate (Cooling rate 2), and cooling from the second cooling temperature to room temperature was performed at the third average cooling rate (Cooling rate 3) shown in Table 2. After annealing, temper rolling (elongation percentage 0.7%) was performed.

A JIS No. 5 tensile test piece was taken from the resulting steel sheet such that the direction at a right angle to the rolling direction was the longitudinal direction (tensile direction). The yield strength (YS), the tensile strength (TS), the total elongation (EL), and the yield ratio (YR) were measured on the basis of a tensile test (JIS Z 2241 (1998)). The results are shown in Table 3.

As for the stretch-flange-formability, the hole expansion ratio (λ) was measured in conformity with the Japan Iron and Steel Federation Standard (JFS T1001 (1996)), where a clearance which was the distance between a die and a punch was set at 12.5% of the sheet thickness, a hole having a diameter of 10 mm was punched, the test piece was set in a tester such that burrs were located on the die side, and then forming was performed with a 60° cone punch. The results are shown in Table 3. In this regard, a steel sheet having λ (%) of 60% or more was a steel sheet having good stretch-flange-formability.

Also, as for the evaluation of degradation of elongation due to aging, after standing at 70° C. for 10 days, EL was measured by the tensile test, then a difference ΔEL of the measured EL from EL of the steel sheet after production and before standing was calculated, and when ΔEL≤1.0%, it was determined that the degree of degradation of EL after aging was low. In view of aging, standing at 70° C. for 10 days corresponds to the state in which standing is performed at 38° C. for 6 months on the basis of a report by Hundy, "Metallurgia, vol. 52, p. 203 (1956)". The results of determination of ΔEL are shown in Table 3.

The volume fractions of ferrite, bainite, and martensite in the steel sheet were determined by polishing a sheet thickness cross-section parallel to the rolling direction of the steel sheet, then etching with 3% nital, performing observation by using a scanning electron microscope (SEM) at the magnification of 2,000 times, and using Image-Pro of Media Cybernetics. Specifically, the area fraction was measured by a point count method (in conformity with ASTM E562-83 (1988)) and the resulting area fraction was a volume fraction.

The average grain size of ferrite was determined as described below. That is, the area of each ferrite grain was able to be calculated by using the above-described Image-Pro, taking in a photograph, in which the individual ferrite grains were distinguished in advance, from a steel sheet microstructure photograph, an equivalent circle diameter of each ferrite grain was calculated from the resulting area, and an average of those values was determined. Also, the average grain size of martensite was determined in the same manner as was the average grain size of ferrite.

The volume fraction of retained austenite was determined on the basis of diffracted X-ray intensity of the face at one-quarter sheet thickness, up to which the steel sheet was polished in the sheet thickness direction. The integral intensities of X-ray diffraction lines of {200} planes, {211} planes, and {220} planes of ferrite of iron and {200} planes, {220} planes, and {311} planes of austenite were measured by an X-ray diffraction method (apparatus: RINT2200 produced by Rigaku Corporation), where the radiation source was a Mo Kα-ray and the acceleration voltage was 50 keV. Then, using these measurement values, the volume fraction of retained austenite was determined on the basis of the calculation formula described in Rigaku Corporation, "X sen kaisetsu handobukku (X-ray Diffraction Handbook)", p. 26, 62-64 (2000). The average C concentration ([Cγ %]) in retained austenite can be determined by calculation, where a lattice constant a (Å) determined on the basis of diffraction plane (200) of fcc iron by using a Co Kα-ray, [Mn %], and [Al %] are substituted into the following formula (1).

$$a=3.578+0.033[C\gamma\%]+0.00095[Mn\ \%]+0.0056[Al\ \%] \quad (1)$$

where, [Cγ %] represents average C concentration (percent by mass) in retained austenite, and [Mn %] and [Al %] represent contents (percent by mass) of Mn and Al, respectively.

The tensile characteristics and the stretch-flange-formability (hole expansion ratio) measured and the measurement results of steel sheet microstructure are shown in Table 3.

As is clear from the results shown in Table 3, all of our examples have complex microstructure including 70% or more, on a volume fraction basis, of ferrite having an average grain size of 15 μm or less, 3% or more, on a volume fraction basis, of bainite, 4% to 7%, on a volume fraction basis, of retained austenite, and 1% to 6%, on a volume fraction basis, of martensite having an average grain size of 5 μm or less, where the average C concentrations of the above-described retained austenite are 0.30% to 0.70%. It is clear that in each of our examples described above, good formability was obtained, where tensile strength of 590 MPa or more and yield ratio of 64% or less were ensured, the total elongation was 31% or more, the hole expansion ratio was 60% or more, and degradation of the total elongation after aging was at a low level. On the other hand, in the Comparative examples, the steel sheet microstructures were not satisfactory and, as a result, at least one characteristic of tensile strength, yield ratio, elongation, hole expansion ratio, and ΔEL after aging was poor.

TABLE 1

| Steel type | Chemical composition (percent by mass) C | Si | Mn | P | S | Al | N | Other components | Remarks |
|---|---|---|---|---|---|---|---|---|---|
| A | 0.09 | 1.19 | 1.61 | 0.01 | 0.003 | 0.03 | 0.003 | — | Adaptation example |
| B | 0.07 | 0.85 | 2.01 | 0.02 | 0.003 | 0.03 | 0.003 | — | Adaptation example |
| C | 0.08 | 1.03 | 1.82 | 0.01 | 0.002 | 0.03 | 0.002 | — | Adaptation example |
| D | 0.09 | 1.12 | 1.85 | 0.01 | 0.003 | 0.03 | 0.003 | V: 0.02 | Adaptation example |
| E | 0.08 | 1.20 | 1.66 | 0.02 | 0.003 | 0.03 | 0.003 | Ti: 0.02 | Adaptation example |
| F | 0.08 | 0.98 | 1.89 | 0.01 | 0.003 | 0.03 | 0.003 | Nb: 0.02 | Adaptation example |
| G | 0.06 | 0.82 | 1.65 | 0.01 | 0.004 | 0.03 | 0.003 | Cr: 0.20 | Adaptation example |
| H | 0.05 | 1.12 | 1.98 | 0.01 | 0.003 | 0.04 | 0.003 | Mo: 0.20 | Adaptation example |
| I | 0.08 | 0.79 | 2.18 | 0.01 | 0.003 | 0.03 | 0.003 | Cu: 0.10 | Adaptation example |
| J | 0.09 | 0.65 | 2.02 | 0.01 | 0.003 | 0.03 | 0.003 | Ni: 0.10 | Adaptation example |
| K | 0.07 | 0.97 | 1.88 | 0.01 | 0.003 | 0.03 | 0.002 | B: 0.0015 | Adaptation example |
| L | 0.09 | 1.28 | 1.72 | 0.01 | 0.003 | 0.03 | 0.002 | Ca: 0.0035 | Adaptation example |
| M | 0.08 | 1.09 | 1.88 | 0.01 | 0.003 | 0.03 | 0.002 | REM: 0.0028 | Adaptation example |
| N | 0.12 | 1.02 | 1.95 | 0.01 | 0.003 | 0.04 | 0.002 | — | Comparative example |
| O | 0.09 | 0.52 | 1.98 | 0.01 | 0.003 | 0.03 | 0.003 | — | Comparative example |
| P | 0.08 | 1.18 | 1.30 | 0.01 | 0.003 | 0.03 | 0.003 | — | Comparative example |
| Q | 0.07 | 1.05 | 2.45 | 0.01 | 0.003 | 0.03 | 0.003 | — | Comparative example |

TABLE 2

| Sample No. | Steel type | Hot rolling condition FDT (° C.) | Elapsed time until start of cooling (s) | Cooling rate (° C./s) | CT (° C.) | Annealing condition Average heating rate (° C./s) | Annealing temperature (° C.) | Annealing time (s) | First cooling temperature (° C.) | Cooling rate 1 (° C./s) | Second cooling temperature (° C.) | Cooling rate 2 (° C./s) | Cooling rate 3 (° C./s) | Remarks |
|---|---|---|---|---|---|---|---|---|---|---|---|---|---|---|
| 1 | A | 890 | 0.5 | 55 | 470 | 10 | 850 | 150 | 840 | 2 | 400 | 15 | 2 | Example |
| 2 | A | 900 | 0.5 | 55 | 470 | 10 | 820 | 150 | 810 | 2 | 450 | 20 | 2 | Example |
| 3 | A | 870 | 0.5 | 55 | 470 | 10 | 850 | 100 | 830 | 3 | 350 | 15 | 2 | Example |
| 4 | A | 900 | 0.5 | 55 | 470 | 10 | 850 | 150 | 840 | 4 | 450 | 10 | 2 | Example |
| 5 | B | 880 | 0.5 | 55 | 400 | 10 | 825 | 150 | 800 | 3 | 400 | 15 | 2 | Example |
| 6 | C | 900 | 0.5 | 55 | 470 | 10 | 850 | 150 | 830 | 2 | 400 | 15 | 2 | Example |
| 7 | C | 860 | 0.5 | 50 | 470 | 10 | 830 | 100 | 820 | 5 | 380 | 15 | 4 | Example |
| 8 | D | 920 | 1 | 55 | 420 | 10 | 875 | 150 | 850 | 2 | 400 | 7 | 5 | Example |
| 9 | E | 880 | 0.5 | 55 | 470 | 10 | 875 | 150 | 860 | 2 | 400 | 15 | 2 | Example |
| 10 | F | 890 | 0.5 | 110 | 470 | 10 | 820 | 100 | 810 | 1 | 450 | 20 | 2 | Example |
| 11 | G | 890 | 1 | 55 | 470 | 10 | 850 | 250 | 830 | 2 | 400 | 15 | 1 | Example |
| 12 | H | 880 | 0.5 | 80 | 550 | 10 | 850 | 250 | 830 | 2 | 400 | 30 | 1 | Example |
| 13 | I | 900 | 0.5 | 55 | 470 | 10 | 850 | 200 | 840 | 2 | 400 | 15 | 1 | Example |
| 14 | J | 930 | 1 | 100 | 470 | 10 | 875 | 150 | 860 | 2 | 425 | 15 | 1 | Example |
| 15 | K | 880 | 0.5 | 55 | 470 | 10 | 850 | 200 | 830 | 2 | 400 | 15 | 2 | Example |
| 16 | L | 900 | 0.5 | 55 | 470 | 10 | 850 | 250 | 830 | 2 | 400 | 15 | 2 | Example |
| 17 | M | 900 | 1 | 55 | 470 | 10 | 850 | 200 | 830 | 2 | 380 | 20 | 2 | Example |
| 18 | C | 880 | 0.5 | 50 | 570 | 10 | 850 | 250 | 830 | 2 | 400 | 10 | 3 | Example |
| 19 | C | 900 | 0.5 | 55 | 470 | 10 | 930 | 150 | 900 | 2 | 400 | 15 | 2 | Comparative example |
| 20 | C | 880 | 1 | 55 | 470 | 10 | 750 | 150 | 740 | 1 | 400 | 15 | 2 | Comparative example |
| 21 | C | 890 | 0.5 | 50 | 470 | 10 | 825 | 150 | 825 | 0 | 400 | 12 | 2 | Comparative example |
| 22 | C | 880 | 1 | 55 | 450 | 10 | 850 | 200 | 780 | 2 | 425 | 12 | 2 | Comparative example |
| 23 | C | 890 | 0.5 | 55 | 450 | 10 | 820 | 150 | 800 | 10 | 400 | 7 | 2 | Comparative example |
| 24 | C | 880 | 0.5 | 55 | 470 | 10 | 890 | 150 | 880 | 2 | 500 | 5 | 1 | Comparative example |
| 25 | C | 900 | 0.5 | 55 | 470 | 10 | 810 | 150 | 800 | 1 | 300 | 10 | 4 | Comparative example |
| 26 | C | 880 | 0.5 | 55 | 450 | 10 | 850 | 200 | 840 | 1 | 400 | 3 | 2 | Comparative example |
| 27 | C | 920 | 0.5 | 55 | 450 | 10 | 840 | 150 | 820 | 2 | 400 | 50 | 2 | Comparative example |
| 28 | C | 880 | 0.5 | 55 | 450 | 10 | 840 | 150 | 825 | 2 | 400 | 10 | 15 | Comparative example |
| 29 | N | 900 | 0.5 | 55 | 450 | 10 | 840 | 150 | 820 | 2 | 400 | 15 | 2 | Comparative example |

TABLE 2-continued

| | | Hot rolling condition | | | | Annealing condition | | | | | | | | |
|---|---|---|---|---|---|---|---|---|---|---|---|---|---|---|
| Sample No. | Steel type | FDT (° C.) | Elapsed time until start of cooling (s) | Cooling rate (° C./s) | CT (° C.) | Average heating rate (° C./s) | Annealing temperature (° C.) | Annealing time (s) | First cooling temperature (° C.) | Cooling rate 1 (° C./s) | Second cooling temperature (° C.) | Cooling rate 2 (° C./s) | Cooling rate 3 (° C./s) | Remarks |
| 30 | O | 900 | 0.5 | 55 | 450 | 10 | 840 | 150 | 820 | 2 | 400 | 15 | 2 | Comparative example |
| 31 | P | 900 | 0.5 | 55 | 450 | 10 | 840 | 150 | 820 | 2 | 400 | 10 | 2 | Comparative example |
| 32 | Q | 900 | 0.5 | 55 | 470 | 10 | 840 | 150 | 820 | 2 | 400 | 10 | 2 | Comparative example |

TABLE 3

| | Steel sheet microstructure | | | | | | | |
|---|---|---|---|---|---|---|---|---|
| | Ferrite | | Bainite | Retained austenite | | Martensite | | |
| Sample No. | Volume fraction (%) | Average grain size (μm) | Volume fraction (%) | Volume fraction (%) | Average C concentration (%) | Volume fraction (%) | Average grain size (μm) | Remainder microstructure* |
| 1 | 85 | 10 | 5 | 6 | 0.67 | 4 | 2 | — |
| 2 | 85 | 9 | 4 | 7 | 0.55 | 4 | 3 | — |
| 3 | 84 | 10 | 6 | 6 | 0.59 | 4 | 3 | — |
| 4 | 86 | 10 | 4 | 5 | 0.59 | 5 | 2 | — |
| 5 | 85 | 8 | 4 | 6 | 0.41 | 5 | 3 | — |
| 6 | 83 | 10 | 6 | 6 | 0.62 | 5 | 4 | — |
| 7 | 83 | 8 | 5 | 6 | 0.62 | 6 | 3 | — |
| 8 | 85 | 9 | 3 | 6 | 0.51 | 4 | 3 | P |
| 9 | 86 | 6 | 4 | 5 | 0.45 | 5 | 2 | — |
| 10 | 86 | 7 | 4 | 4 | 0.61 | 5 | 2 | SC |
| 11 | 86 | 8 | 5 | 4 | 0.55 | 5 | 4 | — |
| 12 | 84 | 9 | 5 | 6 | 0.66 | 5 | 3 | — |
| 13 | 85 | 10 | 5 | 6 | 0.54 | 4 | 2 | — |
| 14 | 84 | 11 | 5 | 6 | 0.59 | 5 | 3 | — |
| 15 | 83 | 8 | 5 | 6 | 0.59 | 5 | 3 | SC |
| 16 | 87 | 9 | 4 | 5 | 0.54 | 4 | 3 | — |
| 17 | 86 | 5 | 5 | 5 | 0.61 | 4 | 2 | — |
| 18 | 84 | 15 | 5 | 5 | 0.45 | 6 | 4 | — |
| 19 | 88 | 18 | 3 | 4 | 0.29 | 5 | 8 | — |
| 20 | 94 | 8 | 2 | 2 | 0.44 | 2 | 3 | — |
| 21 | 79 | 10 | 6 | 8 | 0.41 | 7 | 5 | — |
| 22 | 86 | 9 | 4 | 5 | 0.72 | 5 | 4 | — |
| 23 | 78 | 11 | 8 | 6 | 0.51 | 8 | 4 | — |
| 24 | 89 | 10 | 2 | — | — | 3 | 2 | P |
| 25 | 86 | 9 | 2 | 5 | 0.53 | 7 | 5 | — |
| 26 | 91 | 10 | 2 | — | — | — | — | P, SC |
| 27 | 78 | 8 | 7 | 8 | 0.45 | 7 | 5 | — |
| 28 | 84 | 9 | 6 | 6 | 0.88 | 4 | 5 | — |
| 29 | 86 | 11 | 5 | 5 | 0.72 | 4 | 4 | — |
| 30 | 85 | 10 | 3 | 4 | 0.55 | 7 | 3 | SC |
| 31 | 88 | 9 | 6 | 2 | 0.44 | — | — | P |
| 32 | 85 | 9 | 4 | 3 | 0.41 | 8 | 6 | — |

| | Tensile characteristics | | | | Hole expansion | Δ EL after | |
|---|---|---|---|---|---|---|---|
| Sample No. | YS (MPa) | TS (MPa) | EL (%) | YR (%) | ratio λ (%) | aging (%) | Remarks |
| 1 | 391 | 613 | 37 | 64 | 85 | 0.5 | Example |
| 2 | 389 | 631 | 35 | 62 | 67 | 0.4 | Example |
| 3 | 386 | 667 | 32 | 58 | 63 | 0.7 | Example |
| 4 | 394 | 617 | 37 | 64 | 84 | 0.6 | Example |
| 5 | 398 | 651 | 33 | 61 | 61 | 0.8 | Example |
| 6 | 395 | 621 | 35 | 64 | 79 | 0.1 | Example |
| 7 | 390 | 613 | 36 | 64 | 66 | 0.6 | Example |
| 8 | 388 | 615 | 33 | 63 | 68 | 0.9 | Example |
| 9 | 379 | 600 | 34 | 63 | 61 | 0.8 | Example |
| 10 | 391 | 612 | 32 | 64 | 70 | 0.4 | Example |
| 11 | 390 | 610 | 31 | 64 | 65 | 0.7 | Example |
| 12 | 377 | 595 | 35 | 63 | 78 | 0.5 | Example |
| 13 | 378 | 601 | 32 | 63 | 66 | 0.4 | Example |

TABLE 3-continued

| | | | | | | | |
|---|---|---|---|---|---|---|---|
| 14 | 391 | 613 | 33 | 64 | 69 | 0.6 | Example |
| 15 | 415 | 654 | 31 | 63 | 65 | 0.8 | Example |
| 16 | 381 | 603 | 36 | 63 | 81 | 0.5 | Example |
| 17 | 378 | 599 | 34 | 63 | 76 | 0.4 | Example |
| 18 | 377 | 608 | 31 | 62 | 60 | 0.5 | Example |
| 19 | 365 | 601 | 28 | 61 | 48 | 0.1 | Comparative example |
| 20 | 366 | 576 | 27 | 64 | 81 | 0.9 | Comparative example |
| 21 | 391 | 643 | 29 | 61 | 50 | 0.5 | Comparative example |
| 22 | 421 | 622 | 35 | 68 | 63 | 0.8 | Comparative example |
| 23 | 388 | 651 | 31 | 60 | 44 | 0.3 | Comparative example |
| 24 | 398 | 566 | 29 | 70 | 80 | 0.4 | Comparative example |
| 25 | 388 | 641 | 28 | 61 | 48 | 0.8 | Comparative example |
| 26 | 411 | 572 | 30 | 72 | 80 | 1.5 | Comparative example |
| 27 | 433 | 655 | 32 | 66 | 55 | 0.9 | Comparative example |
| 28 | 425 | 615 | 35 | 69 | 65 | 0.5 | Comparative example |
| 29 | 399 | 609 | 37 | 66 | 61 | 0.8 | Comparative example |
| 30 | 388 | 633 | 30 | 61 | 46 | 0.6 | Comparative example |
| 31 | 399 | 588 | 27 | 68 | 68 | 2.2 | Comparative example |
| 32 | 388 | 661 | 29 | 59 | 40 | 0.3 | Comparative example |

*P: pearlite, SC: spheroidal cementite

The invention claimed is:

1. A high strength cold rolled steel sheet with a low yield ratio comprising a chemical composition containing C: 0.05% to 0.10%, Si: 0.6% to 1.3%, Mn: 1.4% to 2.2%, P: 0.08% or less, S: 0.010% or less, Al: 0.01% to 0.08%, N: 0.010% or less, and the remainder being Fe and incidental impurities, on a percent by mass basis, and a microstructure in which average grain size of martensite is 5 μm or less, and average grain size of ferrite is 15 μm or less, the microstructure consisting of a volume fraction of ferrite of 70% or more, a volume fraction of bainite of 3% or more, a volume fraction of retained austenite of 4% to 7%, a volume fraction of martensite of 1% to 6% and, optionally, spheroidal cementite, wherein average C concentration (percent by mass) in the retained austenite is 0.30% to 0.70%, yield ratio is 64% or less and tensile strength is 590 MPa or more.

2. The high strength cold rolled steel sheet with a low yield ratio according to claim 1, the chemical composition further containing, on a percent by mass basis, at least one element selected from Group A to Group E:

Group A

V: 0.10% or less, Ti: 0.10% or less, and Nb: 0.10% or less;

Group B

Cr: 0.50% or less and Mo: 0.50% or less;

Group C

Cu: 0.50% or less and Ni: 0.50% or less;

Group D

B: 0.0030% or less;

Group E 0.0050% or less in total of at least one of Ca and REM.

3. A method of manufacturing the high strength cold rolled steel sheet according to claim 1, the method comprising:

preparing a steel slab, performing hot rolling to produce a steel sheet, performing pickling, subjecting the pickled steel sheet to cold rolling, and performing annealing under conditions of performing heating to an annealing temperature at 780° C. to 900° C. at an average heating rate of 3° C./s to 30° C./s, performing holding at the annealing temperature for 30 s to 500 s, subsequently performing cooling to a first cooling temperature within a temperature range of (annealing temperature—10° C.) to (annealing temperature—30° C.) at a first average cooling rate of 5° C./s or less, subsequently performing cooling to a second cooling temperature at 350° C. to 450° C. at a second average cooling rate of 5° C./s to 30° C./s, and subsequently performing cooling to room temperature at a third average cooling rate of 5° C./s or less.

4. A method of manufacturing the high strength cold rolled steel sheet according to claim 1, the method comprising:

preparing a steel slab, performing hot rolling under the conditions of steel slab temperature: 1,150° C. to 1,300° C. and finishing delivery temperature: 850° C. to 950° C., starting cooling within 1 second after finishing of the hot rolling, performing cooling to 550° C. or lower at an average cooling rate of 50° C./s or more, performing coiling after the cooling to produce a hot rolled steel sheet, performing pickling, subjecting the pickled hot rolled steel sheet to cold rolling, performing annealing under the conditions of performing heating to an annealing temperature of 780° C. to 900° C. at an average heating rate of 3° C./s to 30° C./s, performing holding at the annealing temperature for 30 s to 500 s, subsequently performing cooling to a first cooling temperature within a temperature range of (annealing temperature—10° C.) to (annealing temperature—30° C.) at a first average cooling rate of 5° C./s or less, subsequently performing cooling to a second cooling temperature at 350° C. to 450° C. at a second average cooling rate of 5° C./s to 30° C./s, and subsequently performing cooling to room temperature at a third average cooling rate of 5° C./s or less.

5. A method of manufacturing the high strength cold rolled steel sheet according to claim 2, the method comprising:

preparing a steel slab, performing hot rolling to produce a steel sheet, performing pickling, subjecting the pickled steel sheet to cold rolling, and performing annealing under conditions of performing heating to an annealing temperature at 780° C. to 900° C. at an average heating rate of 3° C./s to 30° C./s, performing holding at the annealing temperature for 30 s to 500 s, subsequently performing cooling to a first cooling temperature within a temperature range of (annealing temperature—10° C.) to (annealing temperature—30° C.) at a first average cooling rate of 5° C./s or less, subsequently performing cooling to a second cooling temperature at 350° C. to 450° C. at a second average cooling rate of 5° C./s to 30° C./s, and subsequently performing cooling to room temperature at a third average cooling rate of 5° C./s or less.

6. A method of manufacturing the high strength cold rolled steel sheet according to claim 2, the method comprising:

preparing a steel slab, performing hot rolling under the conditions of steel slab temperature: 1,150° C. to 1,300° C. and finishing delivery temperature: 850° C. to 950° C., starting cooling within 1 second after finishing of the hot rolling, performing cooling to 550° C. or lower at an average cooling rate of 50° C./s or more, performing coiling after the cooling to produce a hot rolled steel sheet, performing pickling, subjecting the pickled hot rolled steel sheet to cold rolling, performing annealing under the conditions of performing heating to an annealing temperature of 780° C. to 900° C. at an average heating rate of 3° C./s to 30° C./s, performing holding at the annealing temperature for 30 s to 500 s, subsequently performing cooling to a first cooling temperature within a temperature range of (annealing temperature—10° C.) to (annealing temperature—30° C.) at a first average cooling rate of 5° C./s or less, subsequently performing cooling to a second cooling temperature at 350° C. to 450° C. at a second average cooling rate of 5° C./s to 30° C./s, and subsequently performing cooling to room temperature at a third average cooling rate of 5° C./s or less.

* * * * *